US010634454B2

(12) United States Patent
Pautler

(10) Patent No.: US 10,634,454 B2
(45) Date of Patent: Apr. 28, 2020

(54) DYNAMIC SIGHT

(71) Applicant: James Anthony Pautler, Plano, TX (US)

(72) Inventor: James Anthony Pautler, Plano, TX (US)

( * ) Notice: Subject to any disclaimer, the term of this patent is extended or adjusted under 35 U.S.C. 154(b) by 0 days.

(21) Appl. No.: 16/078,209

(22) PCT Filed: Feb. 24, 2017

(86) PCT No.: PCT/IB2017/051102
§ 371 (c)(1),
(2) Date: Aug. 21, 2018

(87) PCT Pub. No.: WO2017/145121
PCT Pub. Date: Aug. 31, 2017

(65) Prior Publication Data

US 2019/0056199 A1 Feb. 21, 2019

Related U.S. Application Data

(60) Provisional application No. 62/299,363, filed on Feb. 24, 2016.

(51) Int. Cl.

| | |
|---|---|
| ***F41G 1/30*** | (2006.01) |
| ***F41G 1/473*** | (2006.01) |
| ***F41G 3/06*** | (2006.01) |
| ***F41G 1/38*** | (2006.01) |
| ***F41G 3/16*** | (2006.01) |

(52) U.S. Cl.
CPC ..... *F41G 1/473* (2013.01); *F41G 1/30* (2013.01); *F41G 1/38* (2013.01); *F41G 3/06* (2013.01); *F41G 3/165* (2013.01)

(58) Field of Classification Search
CPC ..... F41A 21/40; F41G 1/38; F41G 3/06
USPC ..... 235/404, 407
See application file for complete search history.

(56) References Cited

U.S. PATENT DOCUMENTS

| | | | | |
|---|---|---|---|---|
| 3,685,159 | A * | 8/1972 | Erhard | F41G 3/06 89/204 |
| 6,128,846 | A * | 10/2000 | Walker | F41A 21/40 42/79 |
| 2013/0152447 | A1 | 6/2013 | Östergren et al. | |
| 2013/0169820 | A1 | 7/2013 | Stewart | |
| 2015/0020430 | A1 * | 1/2015 | Tubb | F41G 1/38 42/122 |
| 2015/0106046 | A1 | 4/2015 | Chen et al. | |

OTHER PUBLICATIONS

European Extended Search Report issued in the corresponding international application No. PCT/IB2017051102, dated Aug. 7, 2019.

* cited by examiner

*Primary Examiner* — Daniel A Hess

(57) ABSTRACT

A dynamic sight, mounted on a gun, provides a correct target lead for a moving target.

14 Claims, 6 Drawing Sheets

EXAMPLE CALCULATION
- ASSUME .5 RAD/SEC GUN ROTATION RATE
- PELLET VELOCITY 1000 FT/SEC

| | RANGE YDS | RANGE FT | TARGET VELOCITY FT/SEC | PELLET TRAVEL TIME (MS) | TARGET LEAD (FT) | LEAD ANGLE FAD | ??? |
|---|---|---|---|---|---|---|---|
| 402 | 10 | 30 | 15 | 30 | .45 | .015 | 15 |
| 404 | 20 | 60 | 30 | 60 | 1.8 | .030 | 30 |
| 406 | 30 | 90 | 45 | 90 | 4.05 | .045 | 45 |
| 408 | 40 | 120 | 60 | 120 | 7.2 | .060 | 60 |

DYNAMIC SIGHT

CROSS-REFERENCE TO RELATED APPLICATIONS

This application claims priority to earlier filed provisional patent application No. 62/299,363 entitled "DYNAMIC SIGHT", which was filed on Feb. 24, 2016, the entire contents of which are hereby incorporated by reference

BACKGROUND

The present disclosure is in the field of shooting sports. More particularly, the present disclosure is in the field of shooting moving targets.

There are many shooting sports that involve moving targets, including bird hunting, skeet, and trap. Shooting moving targets requires the shooter to lead the target for a proper hit. The proper target lead is dependent on many factors, including, but not limited to, initial target velocity, target direction, target range, initial shot velocity, and the ballistics of the shot and target. Shooters typically learn proper target lead through a process of trial and error. The input to this learning process after each shot is either a hit result or a miss result. Unfortunately, many beginners to skeet shooting are unable to hit a single target after dozens of shots. Receiving only miss results, the beginner is not able to begin a successful learning process. These frustrated beginners give up on the sport because they fail to establish a proper target lead.

On the other end of the experience spectrum, advanced shooters almost always receive hit results. These shooters have a difficult time improving further since they are not able to differentiate between center hits and moderately off-center hits.

There are a number of training aids that have been devised to help estimate the proper target lead. One type of aid is a physical modification to the sights that presents a fixed lead estimate to the shooter. This estimate is only valid under specific conditions, such as a controlled skeet launch and a specific shooting station. However, variations in the specific skeet launch can invalidate the assumptions used to set the estimated lead. Also, these aids do not provide additional feedback to the shooter after the shot.

Another type of training aid is tracer ammunition. Tracer ammunition makes the actual shot visible to the shooter. This gives the shooter some indication of the direction of a miss, but there are also ambiguous indications. For instance, a miss can first present the shot in front of the target. A fraction of a second later, the shot can be presented behind the target. This ambiguity makes it difficult for the shooter to determine if they had too much or too little lead.

Video analysis is another method to provide post-shot feedback to the shooter. This type of feedback is similar to using tracer ammunition, except that the feedback can be slowed down and analyzed repeatedly. Video collected before and after the shot is examined by the shooter to recreate the experience of the shot for the shooter. Unfortunately, video analysis suffers from the same ambiguity. Further, the feedback received through video analysis still requires the use of trial and error to determine the proper lead.

BRIEF SUMMARY

A dynamic sight, mounted on a gun, that will provide the correct target lead for a moving target is disclosed.

In one embodiment, a method comprises receiving an initial velocity of a projectile, determining a rotation rate of a barrel, determining at least one lead angle of the projectile at one or more ranges and presenting the at least one lead angle to a user device.

In another embodiment, a computing device comprises a processor, a memory operably coupled to the processor, wherein the processor is configured to receive an initial velocity of a projectile, determine a rotation rate of a barrel, determine a range of at least one distance, determine at least one lead angle of the projectile at the at least one distance and present the at least one lead angle to a user device.

In a further embodiment, a non-transitory computer readable medium having computer-executable instructions that when executed by a processor cause the processor to perform receiving an initial velocity of a projectile, determining a rotation rate of a barrel, determining at least two lead angles of the projectile at respective at least two distances and presenting the at least two lead angles at the respective at least two distances to a user device.

DETAILED DESCRIPTION

Figure 1:
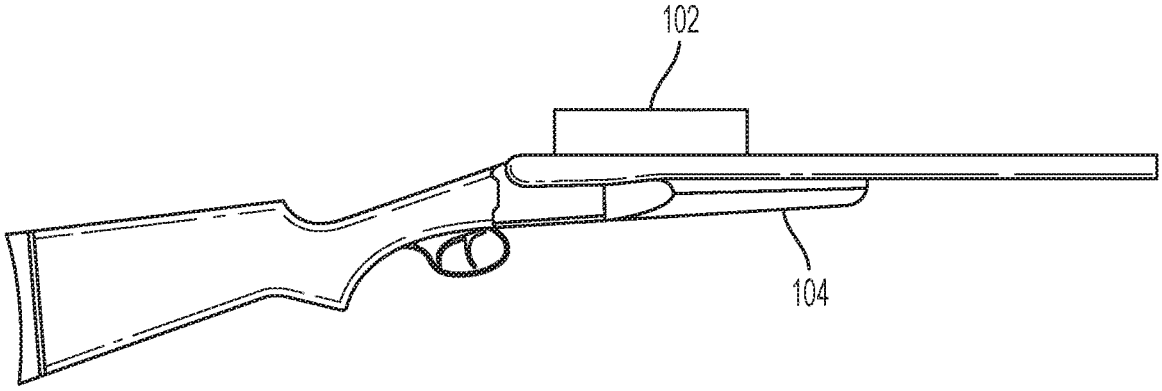
FIG. 1 is a view of a gun showing a device mounted on top according to an embodiment of the instant disclosure.

In FIG. 1 there is an optical sighting device 102 that a shooter will look through when sighting on a target. This is similar to current products on the market that provide a simple red dot or reticle co-aligned with the gun 104. In the instant application, a number of independent dots or reticles are dynamically adjusted by changing their location relative to boresight to indicate new impact locations on the display based on an angular rotation of the gun, muzzle velocity and ballistics of the projectile, and a number of ranges. The angular distance of the impact location relative to boresight is calculated by determining a time of flight of the projectile to the given range and multiplying that time by the angular velocity of the gun. This rotation occurs in at least two orthogonal axes providing an azimuth and elevation measurements at a high repetition rate. The manner in which the dots are displayed is described herein.

Figure 2:
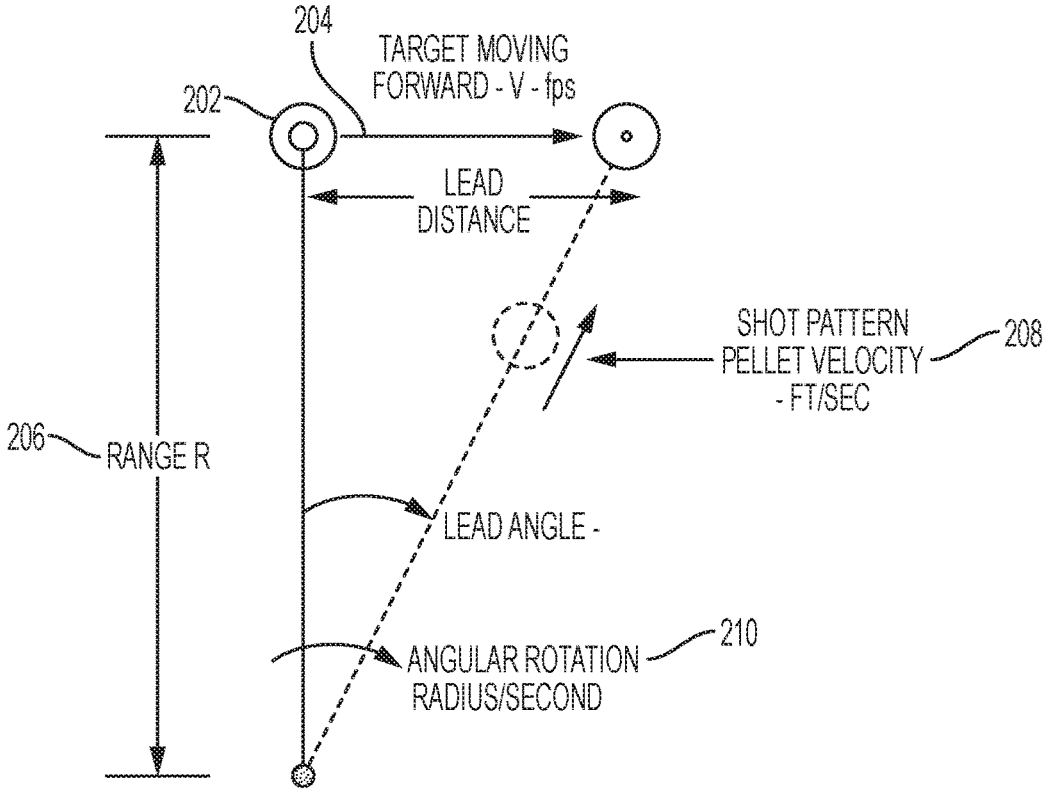
FIG. 2 is a drawing showing lead dynamics and equations for a lead of a target according to an embodiment of the instant disclosure.

FIG. 2 shows the basic mechanics or dynamics of a shooter leading a target. In this case, a simplified analysis is provided where the target is moving at a right angle to the shooter's line of sight and at a constant elevation. This allows a single axis or only the azimuth calculations to be shown.

In this example, let us assume a target 202 is moving at 60 feet per second 204 at a distance of 40 yards 206 (120 feet) from the shooter. Let us also assume the shooter is using ammunition that travels at 1000 feet per second 208 as it exits the muzzle of the gun. This velocity can be read off the box of most factory ammunition or measured using a chronograph, time to distance, or other methods. The linear velocity of the target is estimated using the angular rate of the gun times the assumed distance to the target or by user estimation of the linear velocity. The manner in which the linear velocity is estimated is described herein. Since the projectiles from the gun are traveling much faster than the target (typical shot velocity is over 900 ft/s while clay pigeons and birds are well under 80 ft/s), we can make the simplification that the projectile path is approximately equal to the distance of the target when the shot was fired. It will take 120 milliseconds for the projectiles to travel 120 feet at 1000 feet per second. Since the target is traveling to the right at 60 feet per second, it will travel 7.2 feet while the projectiles are traveling to the target. Hence 7.2 feet is the appropriate physical lead to hit the target. In this example, the target moving at 60 feet per second at a range of 120 feet has an angular rotation rate of the gun of 0.5 radians per second 210 at the time of the shot.

Figures 3, 4:
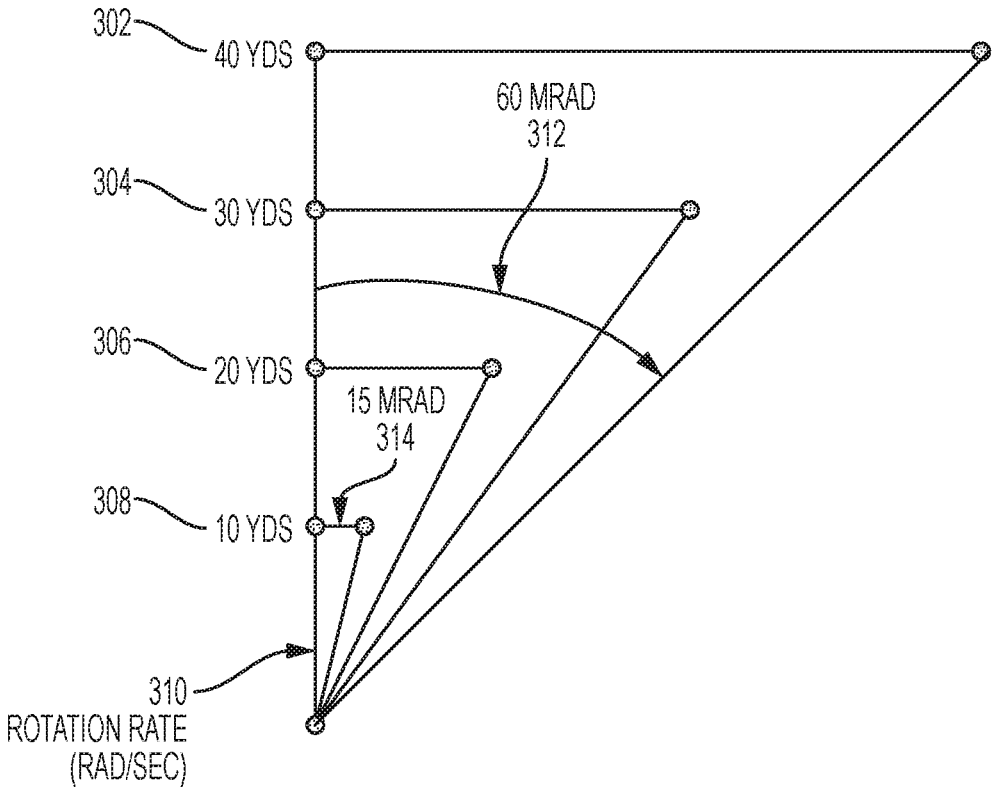
FIG. 3 show the leads for 4 different ranges when an angular rotation of the gun is the same according to an embodiment of the instant disclosure.
FIG. 4 shows the results of the equations of FIG. 1 for a specific example of 0.5 radians per second of gun rotation according to an embodiment of the instant disclosure.

In FIG. 3, we show the relevant target leads for 4 different ranges 302, 304,306,308 when the angular rotation rate of the gun is 0.5 radians per second 310. In this case, targets that are closer to the shooter are traveling at a slower linear velocity to create a situation where the line of sight from the shooter is 0.5 radians per second. As an example, if the target was much closer to the shooter, say 10 yards or 30 feet, then the velocity of the target is 15 feet per second (0.5 radians per second×30 feet). Since the target is so much closer to the shooter and moving at a slower velocity, then the lead is only 0.45 feet.

From the shooter's point of view, the target appears at different positions in the sight as a result of varying angular rates. Each position in the sight corresponds to a different offset angle from the boresight. This is a basic optical principle of physical sighting systems. In this case, at 40 yards range, the lead angular offset as observed in the sight is 60 milliradians 312 (7.2 feet/120 feet). For the 10 yard case, the angular lead is 15 milliradians 314 (0.45/30 feet).

FIG. 4 is a table of data showing the resulting interim calculations for a target moving at 10, 20, 30, and 40 yard ranges 402, 404, 406, 408, with the angular rotation rate of the gun at 0.5 radians per second and the projectile velocity of 1000 feet per second.

Figure 5:
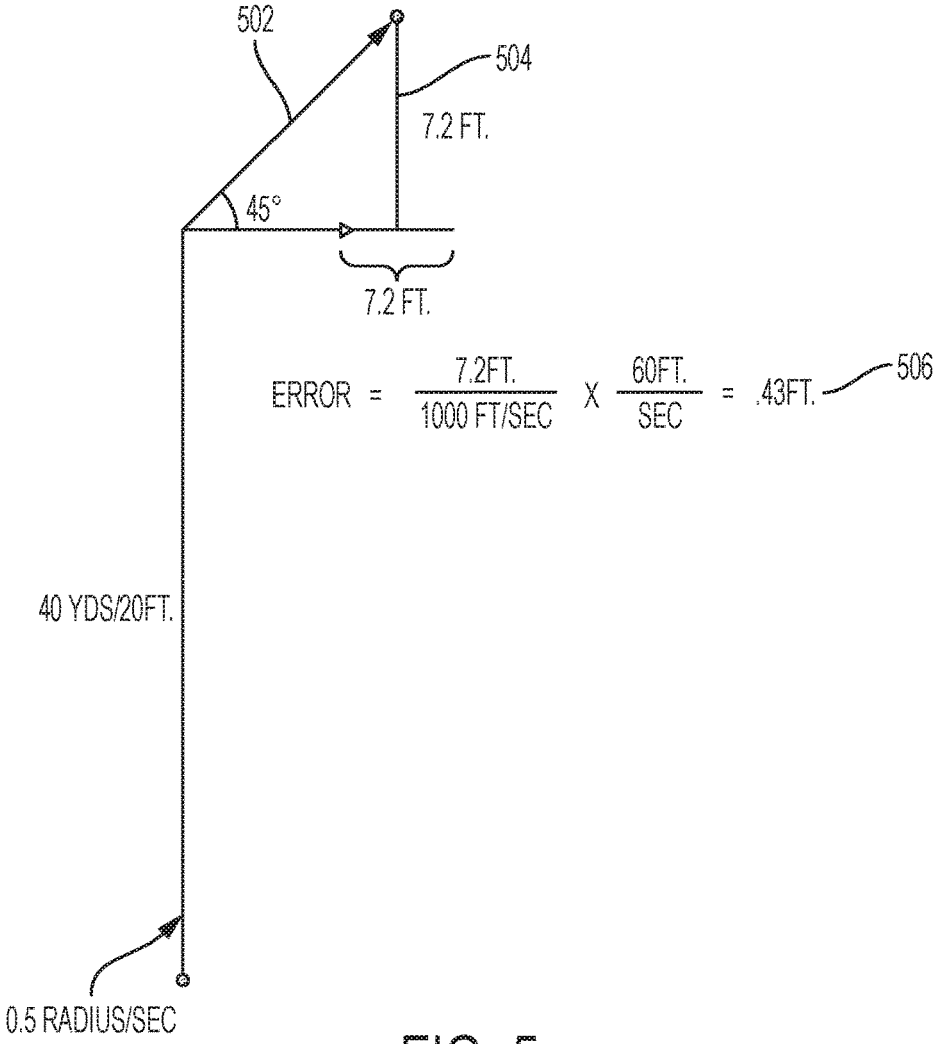
FIG. 5 shows a calculation for a lead error when the target has a worst-case travel orientation according to an embodiment of the instant disclosure.

For the more complex and realistic situations where the target is traveling at a non-right angle to the shooter's line of sight 502, the error in the sighting is very small. As an example, if the target is moving at a 45 degree offset 502 as in FIG. 5, and then the target is moving at a velocity of 85 feet per second with velocity components of 60 feet per second in the orthogonal axes to the line of sight and moving directly away from the shooter at 60 feet per second. In this case, the target is 7.2 feet farther distance 504 and the shoot lead would be (7.2 feet/1000 feet per second)×60 feet per second which is 0.43 feet 506 or 5 inches in error. This percentage error is 0.43/7.2 or 6%. Note, at this range, a shotgun with a full choke has a pattern width of 46 inches or 3.8 feet in diameter. This error is well within the shotgun projectile pattern hitting the target.

Figure 6:
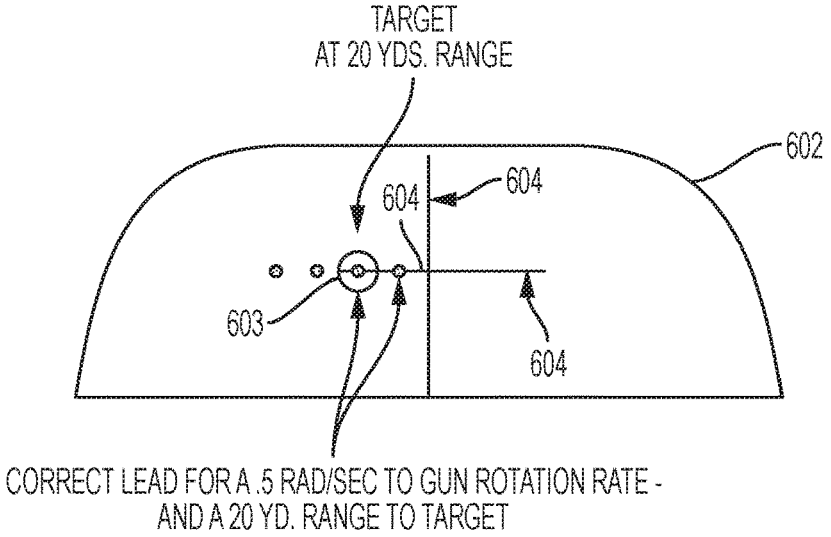
FIG. 6 shows what a shooter would see through the device mounted to the gun for the example in FIG. 1 according to an embodiment of the instant disclosure.

FIG. 6 shows the view that the shooter has when looking through the dynamic sight 602. In general, the shooter will naturally know if the target is near, or far away at the time of the shot. In this case, the four dots 604 on the display represent the appropriate target leads when the range is one of four, i.e. 10, 20, 30 or 40 yards away. The dots represent the projected impact positions of the projectiles and only represent a hit when the target has the same angular rate as the gun. FIG. 6 depicts a target 606 at a 20 yard range moving to the right of the shooter. Thus the crosshairs 608 at the boresight of the gun result in the appropriate lead angle.

Figure 7:
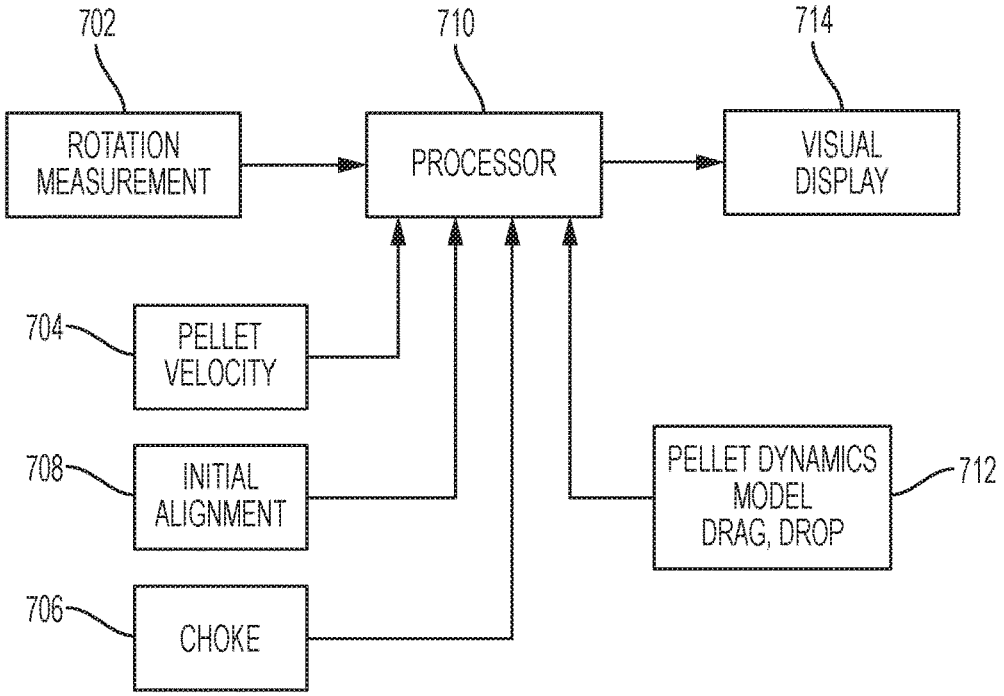
FIG. 7 is a block diagram showing various physical devices and inputs required to perform and display result of the calculations according to an embodiment of the instant disclosure.

FIG. 7 shows the major functional blocks to implement the invention. A rotation measuring device 702 which provides the angular rotation of the gun in at least two axes is measured at a fast sample rate relative to the perception rate of the human eye. In this case, a 30 or more samples per second rate would be appropriate. This information, along with the setup information of projectile velocity 704, choke 706, and boresight alignment 708 is provided to a processor 710. The gun rotation information is provided to the processor through a direct electrical interface, such as I2C. The setup information can be provided by the user through a user interface on the sight using buttons and visual projections through the sight or other LCD display, a USB connection to a computer application, or a wireless connection to a computer or smartphone and stored in non-volatile memory that is accessible to the processor. The processor in turn would compute the appropriate spot positions to be shown on a fast response display which shows the target and the appropriate lead spots or mini reticles. The processor can refine the calculations by taking into account the slowing down of the projectiles due to atmospheric drag and the drop due to the pull of gravity 712 by increasing the time the shot takes to reach the given range which will have an effect on the angle of the reticle to boresight and lowering the reticle in the direction of gravity relative to boresight since the shot is pulled down by gravity. The output of the calculations yields several lead angles that are projected onto or embedded into the display device 714. For example, the display device can be a semitransparent LCD or other type of screen, a hologram, a reflection of a display screen, or projection onto a semitransparent or transparent surface, or mechanical reticles that are physically moved that also allows for an unencumbered view of the target by direct optical sighting. The display device could also consist of glasses, headgear, or any other type of device worn by the user. In the preferred embodiment, the display, processor, and gyros would be located in the optical sighting device mounted in the user's line of sight.

Figure 8:
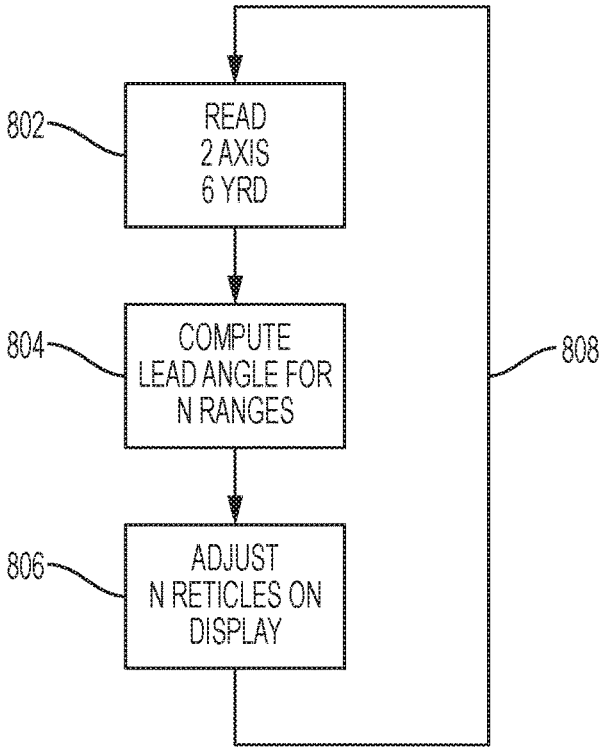
FIG. 8 is a flow chart showing repetitive logic used by the hardware of FIG. 6 according to an embodiment of the instant disclosure.

FIG. 8 shows a repetitive process 808 consisting of: reading the rotation measuring device 802 such as a 3-axis MEMs gyro, computing the new position for the dots 804, and then repositioning the dots on the display 806. This process should happen at a rapid rate so that as soon as the shooter positions the gun dot on to the target, the dots on the display adapt to the correct position with the correct lead angle for the shooter to fire the gun. A user would hold the gun in the shooting position and look through the display device. When the user is aiming at a stationary target, the gun would not be rotating and therefore the reticles would either co-align with the gun boresight or drop from the boresight as a function of gravity, muzzle velocity, and range. If the target is moving and the user is tracking the target with the gun, the gun will be experiencing the same angular rate as the target. If the target is moving left to right from the user's perspective, the reticles will be positioned to the left of the boresight, with the further ranged reticles being to the left of the nearer ranges. As the user speeds up the rotation of the gun, the reticles would spread further apart and away from boresight. The user would align the target with the reticle corresponding to the range to target or in between a further and closer reticle. The range to target is either a guess or estimation by the user, measured distance to a decoy or landmark or other landmark, radar, sonar, laser rangefinder, LIDAR, or other direct measurement. A directly measured range could be displayed in the sight to aid the user or to automatically adjust one or more reticles. For example, the number of yards to the target can be electronically rendered through an LCD display in a corner of the sight to display this directly measured range. Once the user has positioned the target relative to appropriate reticle or reticles, the gun could be fired.

Figure 9:
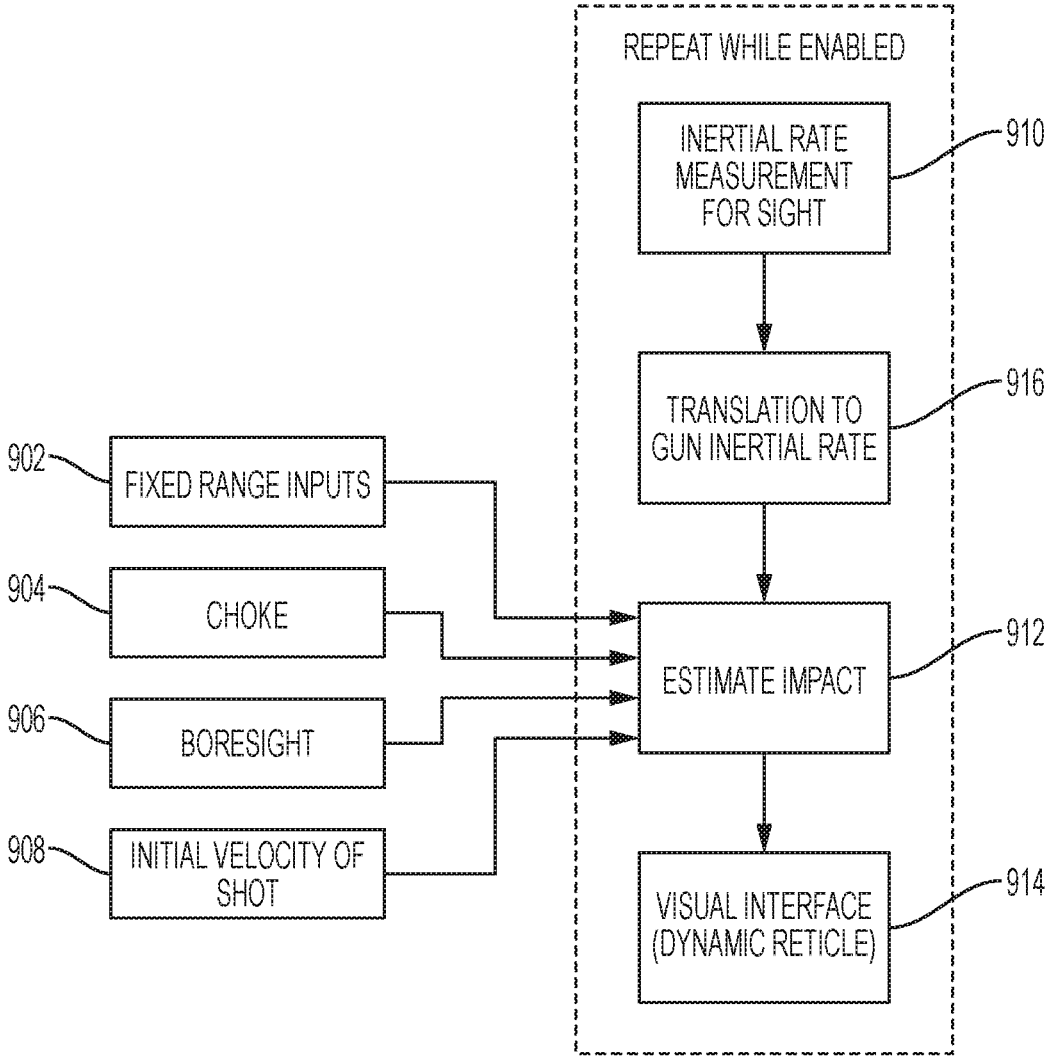
FIG. 9 is a more detailed flow chart showing inputs and internal calculations used herein according to an embodiment of the instant disclosure.

FIG. 9 expands on the process 902, 904, 906, 908, 910, 912, 914 of FIG. 8. An extra processing step allows for a translation of axes 916 to permit an independent device to view and measure the rotation data. An example of this concept is a set of user worn glasses that has an imaging device to determine the gun orientation and an internal rotation measuring device that projects the appropriate targeting information directly to the eye of the shooter.

Figure 10:
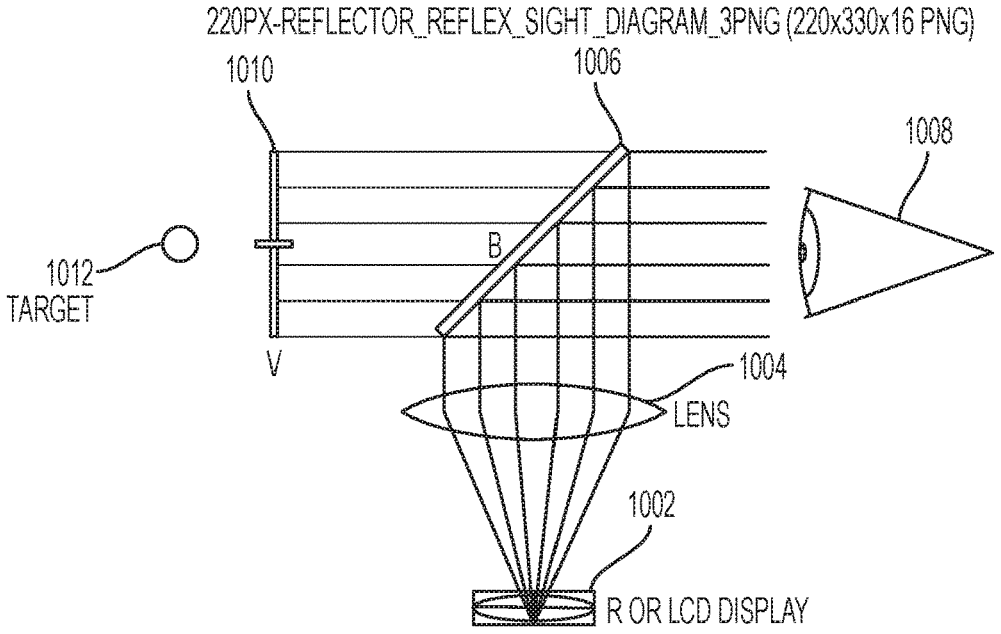
FIG. 10 is a drawing showing a concept of a reflex sight according to an embodiment of the instant disclosure.

FIG. 10 shows the concept of a reflex sight where a reticle or dot is superimposed on the view of the shooter looking at the target. In this embodiment, a reticle or LCD display 1002 is located in the focal plane of a simple lens 1004. This produces a collimated image of the LCD display or reticle 1002. The collimated image is combined using a beam splitter mirror 1006 on top of the direct line of sight of the shooter 1008 looking at the target 1012. This implementation produces a virtual image 1010 superimposed over the target line of sight 1012.

Figure 11:
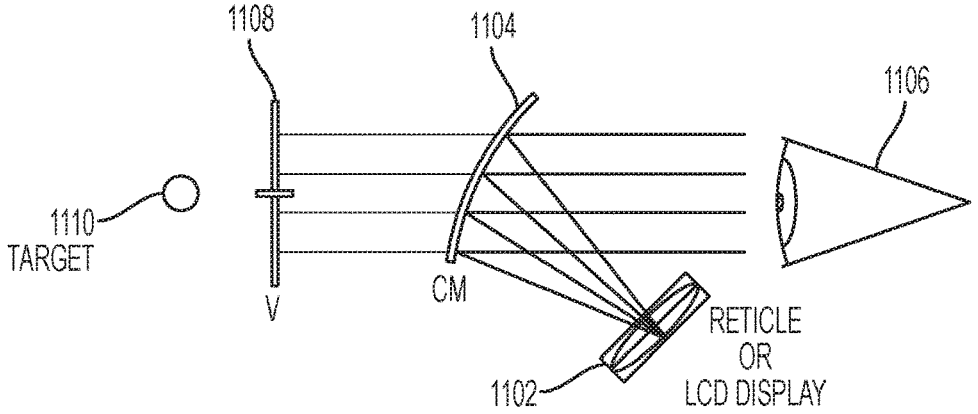
FIG. 11 is a drawing showing a reflex sight with a curved objective lens to collimate the reticle or desired image overlay according to an embodiment of the instant disclosure.

FIG. 11 shows a more modern implementation of the reflex sight where an LCD or reticle 1102 is using the lens properties of a half-silvered curved mirror 1104 to collimate and superimpose the display to the eyeball 1106 of the shooter. The end result is the same where the virtual image 1108 is superimposed over the line-of-sight view of the target 1110.

Figure 12:
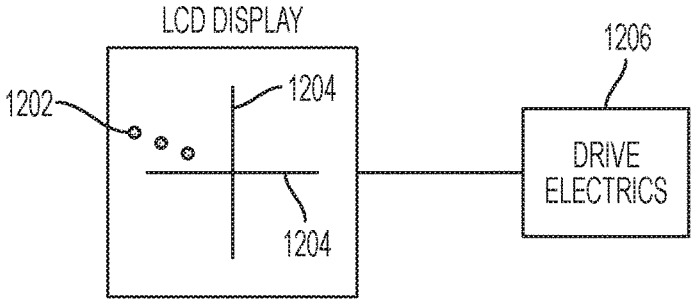
FIG. 12 is a drawing of the display device at the focus of a reflex sight and imaged over the target according to an embodiment of the instant disclosure.

FIG. 12 shows an LCD display in the focal plane of the reflex type of sight. The virtual image that the shooter sees is an inverted version of what is displayed on the LCD. The dots 1202 and the crosshairs 1204 are pixels that are turned on by the driver electronics 1206. The dots are moved around on the display based on the appropriate lead angles determined by the invention's logic.

What is claimed is:

1. A method, comprising:

receiving, via a processor of a sighting device of a firearm, an initial velocity of a projectile of the firearm;

receiving, via the processor, a rotation rate of a barrel of the firearm;

calculating, via the processor, a plurality of lead angles for the projectile at one or more ranges based on the rotation rate of the barrel;

identifying, via the processor, a direction of rotation of the barrel;

displaying, via a display of the sighting device, a plurality of indicia only on a side of a boresight of the gun corresponding to the direction of rotation, where each indicia, of the plurality of indicia, represents a certain lead angle at a certain range; and dynamically adjusting, via the processor, a spacing of the plurality of indicia on the display based on the rotation rate of the barrel.

2. The method of claim 1, wherein the initial velocity of the projectile is determined using a length of the barrel.

3. The method of claim 1, further comprising:

receiving a choke of the barrel; and determining a shot pattern based on the choke.

4. The method of claim 3, wherein the shot pattern is based on a projectile dynamic model.

5. The method of claim 1, wherein the presentation of the lead angle is a visual display.

6. The method of claim 1, wherein the one or more ranges are calculated based on at least one of a radar, sonar, laser rangefinder, optical, and lidar.

7. A computing device, comprising: a processor; and a memory operably coupled to the processor, wherein the processor is configured to: receive an initial velocity of a projectile of a firearm; receive a rotation rate of a barrel of the firearm; calculate a plurality of lead angles for the projectile at one or more ranges based on the rotation rate of the barrel; identify a direction of rotation of the barrel; display, via a display of a sighting device, a plurality of indicia only on a side of a boresight of the gun corresponding to the direction of rotation, where each indicia, of the plurality of indicia, represents a certain lead angle at a certain range; and dynamically adjust a spacing of the plurality of indicia on the display based on the rotation rate of the barrel.

8. The computing device of claim 7, further comprising instructions to:

receive a choke of the barrel; and determine a shot pattern based on the choke.

9. The computing device of claim 8, wherein the shot pattern is based on a projectile dynamic model.

10. The computing device of claim 7, wherein the processor is configured to:

calculate a range is based on at least one of a radar, sonar, laser rangefinder, and lidar.

11. A non-transitory computer readable medium having computer-executable instructions that when executed by a processor cause the processor to perform:

receiving, via a processor of a sighting device of a firearm, an initial velocity of a projectile of the firearm;

receiving, via the processor, a rotation rate of a barrel of the firearm;

calculating, via the processor, a plurality of lead angles for the projectile at one or more ranges based on the rotation rate of the barrel;

identifying, via the processor, a direction of rotation of the barrel;

displaying, via a display of the sighting device, a plurality of indicia only on a side of a boresight of the gun corresponding to the direction of rotation, where each indicia, of the plurality of indicia, represents a certain lead angle at a certain range; and dynamically adjusting, via the processor, a spacing of the plurality of indicia on the display based on the rotation rate of the barrel.

12. The non-transitory computer readable media of claim 11, further comprising computer-executable instructions that when executed by the processor cause the processor to perform:

receiving a choke of the barrel; and determining a shot pattern based on the choke.

13. The non-transitory computer readable media of claim 12, wherein the shot pattern is based on a projectile dynamic model.

14. The non-transitory computer readable media of claim 11, further comprising computer-executable instructions that when executed by the processor cause the processor to perform:

calculating a range is based on at least one of a radar, sonar, laser rangefinder, and lidar.

* * * * *